US011786923B2

(12) United States Patent
Brugger

(10) Patent No.: US 11,786,923 B2
(45) Date of Patent: Oct. 17, 2023

(54) METERING PUMP

(71) Applicants: Crystal Intl. Inc., Toronto (CA); Gerhard Brugger, Pflach (AT)

(72) Inventor: Gerhard Brugger, Pflach (AT)

(73) Assignee: Crystal International, Inc., Toronto (CA)

( * ) Notice: Subject to any disclaimer, the term of this patent is extended or adjusted under 35 U.S.C. 154(b) by 574 days.

(21) Appl. No.: 15/534,333

(22) PCT Filed: Nov. 30, 2015

(86) PCT No.: PCT/EP2015/002407
§ 371 (c)(1),
(2) Date: Jun. 8, 2017

(87) PCT Pub. No.: WO2016/091364
PCT Pub. Date: Jun. 16, 2016

(65) Prior Publication Data

US 2017/0341097 A1 Nov. 30, 2017

(30) Foreign Application Priority Data

Dec. 10, 2014 (DE) ..... 20 2014 009 706.2

(51) Int. Cl.
*B05B 11/10* (2023.01)
*F04B 13/00* (2006.01)
(Continued)

(52) U.S. Cl.
CPC ..... *B05B 11/1008* (2023.01); *B05B 11/1023* (2023.01); *B05B 11/1047* (2023.01);
(Continued)

(58) Field of Classification Search
CPC ..... B05B 11/3008; B05B 11/3069; B05B 11/3047; B05B 11/3074; B05B 11/3023;
(Continued)

(56) References Cited

U.S. PATENT DOCUMENTS 6,685,062 B1 * 2/2004 Ki ..... B05B 11/3025 222/321.7
7,954,677 B2 6/2011 Langlois et al.
(Continued)

FOREIGN PATENT DOCUMENTS

DE 1528603 1/1965
DE 102007026521 12/2007
(Continued)

OTHER PUBLICATIONS

European Patent Office, International Search Report, dated Feb. 19, 2016.

*Primary Examiner* — Charles G Freay
*Assistant Examiner* — Lilya Pekarskaya
(74) *Attorney, Agent, or Firm* — Price Heneveld LLP

(57) ABSTRACT

Disclosed is a metering pump comprising a housing that extends from an inlet region to an outlet and surrounds a
(Continued)

piston which is urged into a starting position by a compression spring. In the metering pump the stop limiting the lifting stroke of the piston is formed by the lower end of the piston coming in contact with the inlet portion.

15 Claims, 3 Drawing Sheets

(51) Int. Cl.
*F04B 53/14* (2006.01)
*F04B 53/16* (2006.01)
*F04B 23/02* (2006.01)

(52) U.S. Cl.
CPC ..... *B05B 11/1069* (2023.01); *B05B 11/1074* (2023.01); *F04B 13/00* (2013.01); *F04B 23/025* (2013.01); *F04B 53/14* (2013.01); *F04B 53/162* (2013.01)

(58) Field of Classification Search
CPC ..... B05B 11/1008; B05B 11/1069; B05B 11/1047; B05B 11/1074; F04B 23/025; F04B 53/162; F04B 53/14; F04B 13/00
USPC ..... 222/321.9, 601, 602; 220/592.18
See application file for complete search history.

(56) References Cited

U.S. PATENT DOCUMENTS

| | | | | |
|---|---|---|---|---|
| 8,631,976 | B2 * | 1/2014 | Moretti | B05B 11/3008 222/321.9 |
| 2012/0006854 | A1 * | 1/2012 | Carta | B05B 11/3023 222/321.7 |
| 2012/0080454 | A1 * | 4/2012 | Wang | B05B 11/3023 222/321.2 |
| 2012/0267399 | A1 * | 10/2012 | Moretti | B05B 11/3047 222/321.2 |

FOREIGN PATENT DOCUMENTS

| | | | | |
|---|---|---|---|---|
| DE | 202007017692 | | 3/2008 | |
| EP | 1938903 | A2 * | 7/2008 | B05B 11/3023 |
| WO | 9853917 | | 12/1998 | |
| WO | 2010113198 | | 7/2010 | |

* cited by examiner

METERING PUMP

BACKGROUND OF THE INVENTION

Metering pumps of this type are used for dispensing liquids or pastey products like e.g. liquid soaps or cosmetics. Thus typically a suction hose reaches into a plastic bottle so that actuating the metering pump in particular by depressing a piston suctions a predetermined volume of the product and feeds it to a product outlet in particular a dispensing nozzle.

The actuation element (push button or also lever) is typically preloaded by a compression coil spring into a starting position in an elastic manner and can be depressed wherein a piston typically with a hollow piston rod moves within a typically cylindrical metering chamber. After the actuation the piston is reset by the spring force and the product is suctioned in by an inlet valve wherein the spring should be arranged for cosmetic products outside of the product feed path. A metering pump of this type is known e.g. from the U.S. Pat. No. 3,187,960. The pump stroke is thus obtained by a flange that is radially expanded at the piston rod so that the support cylinder or the housing has a realtively large diameter.

Eventually a metering dispenser is known form U.S. Pat. No. 3,194,447 in which an spring predoaded piston is supported in an elongated housing as a single piston element. The piston is covered at its lower end with a piston shoe which has to perform a stop function when the piston contacts in a lower position as well as a sealing function relative to the housing in which the piston is supported. This is disadvantageous in that a harder plastic material has to be selected for the stop function of the piston and a softer plastic material has to be selected for the sealing function of the piston. This functional mix, this functional mix causes an increased risk of damaging the piston since the stop portion arranged above the inlet valve in this pump has a reduced contact surface due to cross shaped radial grooves arranged in its contact surface. Thus an increased pressure is applied to the contacting piston.

In order to overcome these disadvantages it is known from U.S. Pat. Nos. 7,954,677 and 8,631,976 to configure the piston from multiple components in that an inner piston plunger or piston is enveloped by an additional piston element in a concentric arrangement. Thus the plunger can be made from a compartively stronger material and the surrounding piston element can be made according to the required sealing function from a softer material in particular a plastic material. In the pump according to U.S. Pat. No. 8,631,976 the spring loaded piston that is made from plural components is supported in a housing element which is defined at an upper end that is oriented away from the inlet valve with an inward protruding annular shoulder forming an upper stop for the piston in its idle position and provided with a lower inward protruding annular shoulder which is also arranged in an upper portion of the housing and which is used as a contact surface for limiting a stroke of the piston in its lower position. This configuration with inward protruding annular shoulders necessitates configuring the housing element in two components in order to facilitate mold extraction of an injection molded plastic material. This increases the number of components and also the sealing function, in particular when the piston contacts ontop is problematic since also the piston plunger contacts at a sleeve in its upper starting position with the piston element connected there between. Sealing problems are last no least caused by the piston in its upper stroke position in which the housing chamber can be filled contacts the upper annular shoulder on the one hand side so that the upward stroke of the piston is limited, but also by the inner piston plunger which contacts and loads the two part sleeve through the piston element.

The metering pump described in U.S. Pat. No. 7,954,677 is configured similar, thus divided in two in that an inner piston plunger which is received in the piston by an interlocking connection is concentrically enveloped by a piston element that is moveable relative to the inner piston plunger, wherein the piston element substantially takes over the sealing function. Also here the stop is configured in the upper portion of the housing thus by an inward protruding annular shoulder of a sleeve that is inserted into the housing from above. Due to this stroke limitation of the piston in the upper portion of the housing component a lower portion of the piston at least approaches the inlet portion in the end portion.

Thus, a ball valve is configured as an inlet valve, wherein the ball valve does not seal self acting under high viscosity of the feed medium and does not allow overhead metering at all or only allows overhead metering to an insufficient extent. On the one hand side the preceding disadvantages of a rather high installed volume and complexity also apply for this embodiment since different components are provided for different metering volumes.

Thus, it is an object of the invention to provide a metering pump with high functional safety and low complexity and low production costs. According to another aspect of the invention the metering volume shall be variable by using a shorter housing in a simple manner while maintaining all essential functions.

SUMMARY OF THE INVENTION

A metering pump of this type is characterized in that the stroke limiting stop of the piston is formed in its end position by a lower end of the piston contacting the inlet portion, in particular with a circumferential edge, for example by an inward protruding housing shoulder or like a bead proximal to the inlet valve or with the inlet valve itself. Thus the inlet valve is contacted during every actuation so that a possibly moved seal element is pressed back into its sealing seat. A movement of this type can occur for example when the metering pump is held at a high slant angle or even used "overhead" and then the plastic bottle is hit in order to accelerate an exit of the paste. The stop in the inlet portion facilitates a correction of a misalignment possibly already caused during assembly so that overall safe operations are provided. furthermore the metering pump has a lower configuration based or assembly complexity due to omitting the previously used upper stop and/or different component lengths which has an advantageous effect in that a variation of a size of the metering chamber and thus of the metering amount is facilitated by changing the exterior housing.

In an advantageous embodiment the compression spring required for resetting is arranged about the feed path so that a compact configuration is achieved and it is assured that sensitive cosmetic products do not come in contact with metal. Depending on the required metering volume per piston stroke the housing can be formed with different axial lengths for forming differently sized metering chambers. Thus the pump mechanism itself can remain unchanged. In particular the piston and the compression spring with adjacent components form a prefabricated assembly so that they can be used for different metering dispensers with different metering volumes. Thus it is also important that the piston includes a plunger with a lower expansion so that the inlet valve can loaded and can be realigned in an exact sealing position after a misalignment e.g. when storing the metering dispenser in a slanted or inverted position.

BRIEF DESCRIPTION OF THE DRAWINGS

Other advantages of the invention are evident from the subsequent description provided with reference to the drawing figure, wherein.

DETAILED DESCRIPTION OF THE PREFERRED EMBODIMENTS

Figure 2:
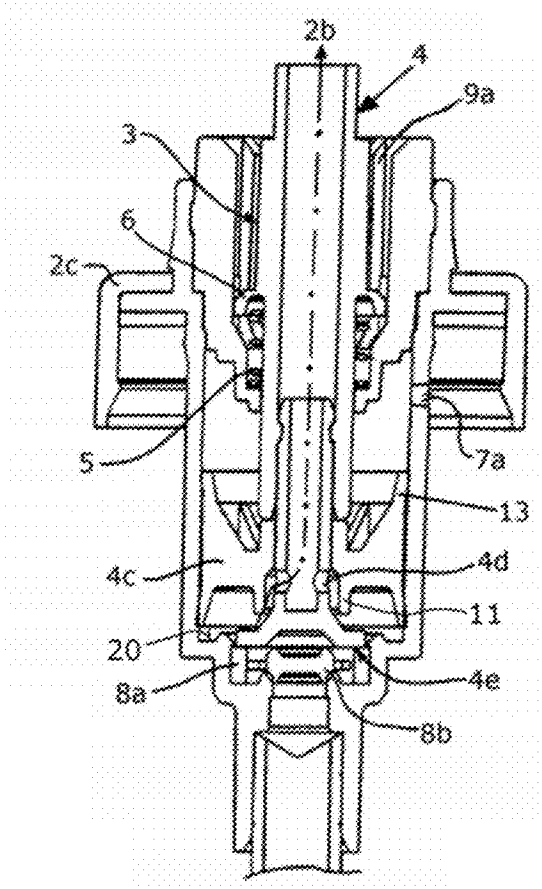
FIG. 2 illustrates a longitudinal sectional view according to FIG. 1 in a lower end position.
Figure 1:
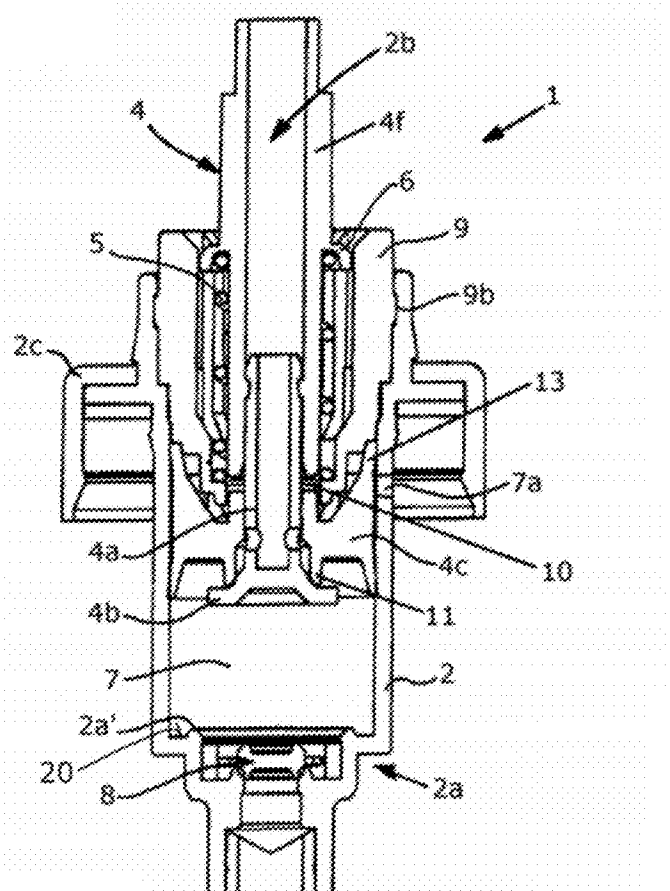
FIG. 1 illustrates a metering dispenser in a starting position according to a first embodiment wherein the metering dispenser is configured for a first metering volume.

According to FIG. 1 the metering pump 1 includes a tubular housing 2 which extends along the vertical axis between a lower inlet portion 2*a* and an upper dispensing opening 2*b* in order to feed the product from a non-illustrated (lower container). An axially moveable piston 4 is arranged in the housing 2 wherein the piston 4 can be depressed within a support cylinder 3 between the starting position (FIGS. 1 and 3) and an end position proximal to the inlet 2*a* (FIGS. 2 and 4) against the compression spring 5. The compression spring 5 arranged on an outside at a central feed path is supported in an upward direction at a flange 6 which is formed at the piston 4 or its hollow piston rod 4*f*. A flange 6 can be furthermore provided for an exact support of the piston 4 during depressing (c.f. FIG. 2) wherein the cylinder 3 thus includes radially inward oriented bars 9*a* in order to minimize friction. Thus additionally a cap nut or a snap closure 2*c* are externally placed onto the housing 2 in order to connect the metering pump 1 with the container for the product to be metered thus by simply pressing the snap closure 2*c* onto the housing.

The housing 2 and the lower end 4*e* of the piston 4 define a metering chamber 7 into which the piston can penetrate. The volume of the metering chamber 7 is thus defined by the amount of product to be fed as evident from a comparison of the relative long housing of FIG. 1 and FIG. 2 with the relative short housing of FIGS. 3 and 4. The piston 4 is advantageously identically configured in both embodiments and can respectively release a ventilation bore whole 7*a* in the right facing wall of the housing 2 when being depressed. However in the respective starting position (FIGS. 1 and 3) the ventilation bore whole 7*a* is sealed by the piston 4. The piston 4 or its piston rod 4*f* is configured hollow in a center in order to facilitate feeding the product to the upper dispensing portion 2*b*. A disc shaped inlet valve 8 can be provided in the inlet portion 2*a* wherein the disc shaped inlet valve 8 is safely pressed in contact by the lowest portion 4*e* of the piston 4 and thus always closed in a sealing manner. Should the inlet valve 8 have moved for example when suctioning the product or already during assembly it is exactly realigned in its sealing seat?

A sleeve 9 is inserted into the housing about the compression spring 5, advantageously attached with a press in edge 9*b* in the housing 2. The sleeve 9 is advantageously integrally configured in one piece, in particular as an injection molded plastic component. Radial bars 9*a* can be configured at an inner surface of the sleeve. A similar snap locking or clip connection is provided for the hollow piston 4, namely for its lower portion in the form of a plunger 4*a*, which has a flange shaped expansion 4*b* in a downward direction. Between this expansion 4*b* and the lower edge of the sleeve 9 a jacket shaped piston element 4*c* is arranged which is advantageously made from polyethylene so that plural sealing edges or portions are formed within the metering chamber 7. In particular the plunger 4*a* is made from a harder material than the concentrically arranged element 4*c*.

Figure 3:
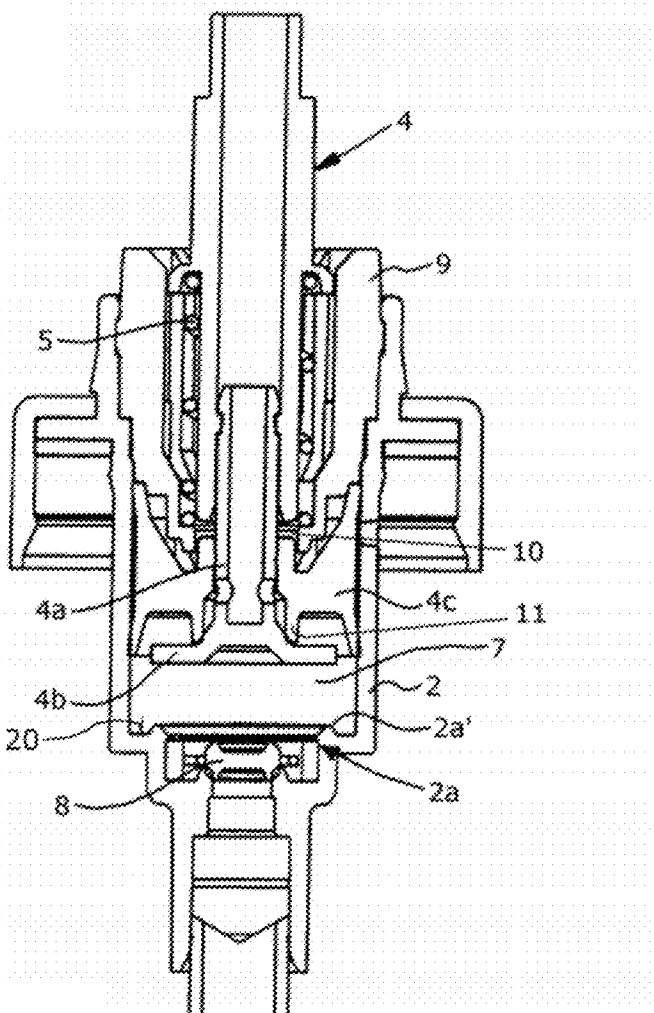
FIG. 3 illustrates a depiction according to FIG. 1 wherein the housing of the metering pump has a smaller volume.

Thus, it can be advantageously provided that the lower end of the sleeve 9*a* is used in the starting position according to FIGS. 1 and 3 as a stop for the piston element 4*c*. Thus the upper outer edge of the piston element 4*c* in FIG. 1 and also in FIG. 3 contacts an outer shoulder of the sleeve 9. When depressing the piston 4 the piston element 4*c* is moved along proximal to the inlet portion 2*a* but not moved into contact. Thus according to FIG. 1 the lower end of the piston 4 is arranged at a distance from the piston element 4*c* that is evident from FIGS. 1 and 3, wherein the gap thus formed is designated as 10. When depressing the piston 4 the piston 4*c* is moved along by the piston 4 with a certain amount of delay. Thus annular gap opens between the expansion 4*b* and an inner lower edge of the piston element 4*c* or the downward oriented tongue or annular inner sealing skirt 11 of the piston element 4*c*, wherein the product can be fed through the annular gap (dashed dotted line in FIG. 2). For this purpose the plunger 4*a* is formed hollow as well and advantageously includes plural pass through openings 4*d* so that depressing the piston 4 and thus opening the plunger 4*a* allows the product to flow through the open annular gap to the piston element 4*c* to the central dispensing opening 2*b* in the piston 4 or its piston rod. As evident from FIG. 1 the inner piston plunger 4*a* is supported at the piston element in the upper starting position, in particular by the tongue 11 and the additional tongue or annular outer sealing skirt 13 at a lower end of the advantageously one piece 9 which is advantageous for correct sealing.

Figure 4:
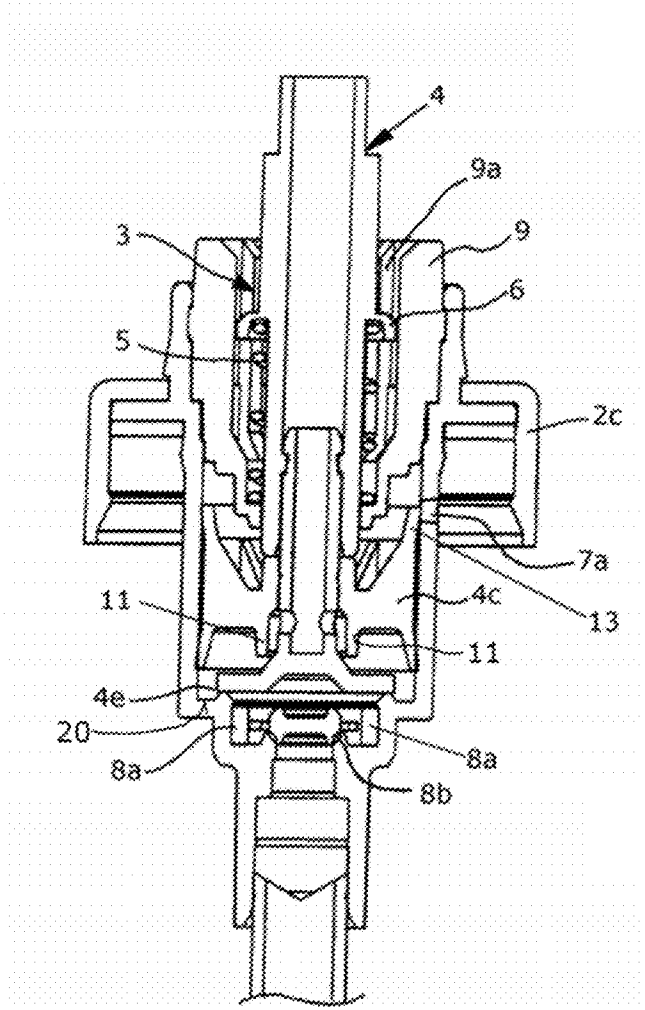
FIG. 4 illustrates a longitudinal sectional view similar to FIG. 2.
Figure 5:
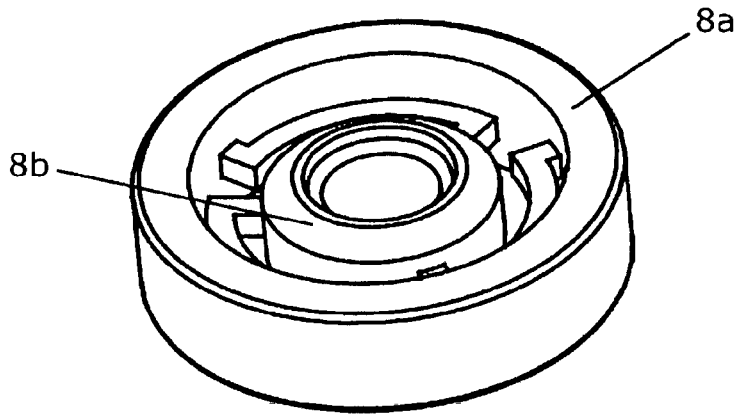
FIG. 5 illustrates a suitable inlet valve.

Thus, it is essential that the lower end 4*e* contacts the inlet portion 2*a*, in particular the inlet valve 8 or its sealing disc 8*a* or the seal plug 8*b* in order to realign the inlet valve 8 from a deviation. As evident from the figures the seal disc 8*a* is clamped in the housing, the circumferential edge 2*a*' of the base portion 20 reaches over the seal disc 8*a*, wherein the seal disc 8*a* is connected with the central sealing plug 8*b* through the horizontal bars evident from the figures. Thus the sealing plug 8*b* is suspended spring loaded and can move under a negative pressure in an upward direction into an open position when the piston 4 moves up and is then moved back into its closed position according to the FIGS. 1 and 3 due to the sealing disc 8*a* being supported relative to the housing by the spring loaded suspension. Thus the expansion 4*b* engages a circumferential edge 2*a*' of the base portion 20, like a bead. Simultaneously this stop provides the stroke limitation of the piston 4. FIG. 5 illustrates the inlet valve 8 in a perspective view. Advantageously however the illustrated circumferential sealing disc 8*a* is connected by bars with the sealing plug 8*b*, which yields a desired elasticity but also a suitable contact surface for the piston, in particular the piston plunger. In FIGS. 3 and 4 the expansion 4*b* is configured with a larger diameter so that the outer edge of the expansion 4*b* contacts the circumferential bead 2*a*' at a face side in the end position. Also here misalignments of the sealing disc 8*a* or of the sealing plug 8*b* can be corrected, wherein an inward protruding housing shoulder can also be used as a stop instead of a bead, like circumferential edge 2*a'*.

The second embodiment of the metering pump 1 illustrated in FIGS. 3 and 4 differs from the first embodiment (FIGS. 1 and 2, remainder of the configuration of the piston 4 remains the same) using a housing 2 that is shorter along the vertical axis and thus a smaller metering volume. For this embodiment the same components can be used which is advantageous for mass products of this type. Without manual actuation the piston 4 is also preloaded by the compression spring 5 in an upward direction into its starting position (FIG. 3 similar to FIG. 1). The piston element 4*c* advantageously made from an elastic polyethylene thus contacts a lower end of the sleeve 9 so that a sealing contact is provided in an outward direction. Only after depressing (FIG. 4) the bleed hole 7*a* is open. As recited supra the sleeve 9 has radially inward oriented bars 9*a* which provide low friction support but which also reduce wall thickness and thus material requirement for the sleeve 9.

The piston 4 with its components 4*a*, 4*b*, 4*c*, the compression spring 5 and the sleeve 9 configured as a support cylinder thus advantageously form a mounting unit which can be used for different types of metering pumps 1 which differ e.g. with respect to a size of the metering chamber 7 like in both embodiments recited supra. This yields substantial cost savings. Additionally the metering pump 1 is particularly compact due to the proposed end stop in or at the inlet portion 2*a* and functional very safe due to the provided correction of misalignments of the inlet valve 8.

The invention claimed is:

1. A metering pump, comprising:

a housing which extends from an inlet portion to a dispensing opening and which envelops a piston which is loaded by a compression spring in a starting position and which is moveable against a spring force of the compression spring into an end position, wherein a lift stroke of the piston is defined by a stop at the end position and the piston includes a piston plunger which is enveloped by a piston element which is movably arranged on the piston plunger;

wherein the inlet portion includes a disc-shaped inlet valve that includes a circumferential seal disc being connected with a central seal plug via horizontal ribs with the circumferential seal disc being clamped in the housing, and wherein the stop at the end position of the lift stroke of said piston is defined by the piston abutting the circumferential seal disc of the disc-shaped inlet valve.

2. The metering pump according to claim 1, wherein the compression spring is arranged about a hollow piston rod provided by the piston.

3. The metering pump according to claim 1, wherein the disc shaped inlet valve includes a spring-biased sealing plug and an outer sealing disc.

4. The metering pump according to claim 1, wherein a one-piece sleeve is inserted into the housing and supports the piston.

5. The metering pump according to claim 4, wherein the one-piece sleeve is at least one of interlocked in the housing and pressed into the housing.

6. The metering pump according to claim 1, wherein the piston plunger includes a lower expansion.

7. The metering pump according to claim 1, wherein the plunger has plural pass through openings.

8. The metering pump according to claim 4, wherein a preassembled mounting unit comprises the piston, the compression spring and the one-piece sleeve.

9. A metering pump comprising:

a housing which extends from an inlet portion to a dispensing opening and which envelops a piston which is loaded by a compression spring in a starting position and which is moveable against a spring force of the compression spring into an end position, wherein a lift stroke of the piston is defined by a stop at the end position and the piston includes a piston plunger which is enveloped by a piston element which is movably arranged on the piston plunger;

wherein the inlet portion includes a disc-shaped inlet valve that includes a circumferential seal disc being connected with a central seal plug via horizontal ribs with the circumferential seal disc being clamped in the housing; and wherein the stop at the end position of the lift stroke of the piston is defined by a base portion of the housing from which the inlet portion extends.

10. The metering pump of claim 1, wherein the housing includes a base portion having a circumferential edge which clamps the circumferential seal disk.

11. The metering pump according to claim 4, wherein the one-piece sleeve includes radial bars in an inner portion which support the piston.

12. The metering pump according claim 4, wherein the lift stroke of the piston is further defined by a stop at the starting position, wherein the stop at the starting position is defined by the piston plunger contacting the one-piece sleeve via the piston element arranged therebetween.

13. The metering pump according to claim 12, wherein a lower end of the one-piece sleeve is configured to contact the piston element.

14. The metering pump according to claim 13, wherein the piston plunger includes a lower expansion that contacts an inner annular sealing skirt of the piston element and the piston element contacts the one-piece sleeve through an outer annular sealing skirt of the piston element in the stop at the starting position.

15. The metering pump according to claim 1, wherein the piston and the piston plunger comprise a plastic injection molding and wherein a material of the piston comprises a soft material providing a seal between the piston and the piston plunger and a material of the piston plunger comprises a material that is harder than the material of the piston.

* * * * *